United States Patent [19]

Cook et al.

[11] Patent Number: 5,065,575

[45] Date of Patent: Nov. 19, 1991

[54] AIR FLOW/CHECK VALVE

[75] Inventors: John E. Cook; Murray F. Busato, both of Chatham, Canada

[73] Assignee: Siemens Automotive Limited, Chatham, Canada

[21] Appl. No.: 601,095

[22] Filed: Oct. 25, 1990

Related U.S. Application Data

[63] Continuation-in-part of Ser. No. 440,941, Nov. 22, 1989, abandoned.

[51] Int. Cl.[5] ..... F01N 3/22

[52] U.S. Cl. ..... 60/290; 60/289; 137/510

[58] Field of Search ..... 60/289, 290, 307, 293; 137/510

[56] References Cited

U.S. PATENT DOCUMENTS 3,931,710 1/1976 Härtel ..... 60/290
4,104,879 8/1978 Nohira ..... 60/290
4,370,102 1/1983 Sasaki ..... 137/510
4,589,254 5/1986 Kume ..... 60/289

FOREIGN PATENT DOCUMENTS 96997 4/1923 Switzerland ..... 137/510

*Primary Examiner*—Douglas Hart
*Attorney, Agent, or Firm*—George L. Boller; Russel C. Wells

[57] ABSTRACT

An air flow/check valve for an exhaust emission system combines flow and check functions into a single valve which is especially well-suited for use with an electric motor driven air pump. The valving mechanism is operated by a fluid actuator, and pressure conditions in the actuator are controlled by sensing the pressure differential across the valving mechanism to close the valving mechanism when exhaust back pressure is indicative of causing potentially damaging backflow to the air pump. Several embodiments of the invention are disclosed.

69 Claims, 8 Drawing Sheets

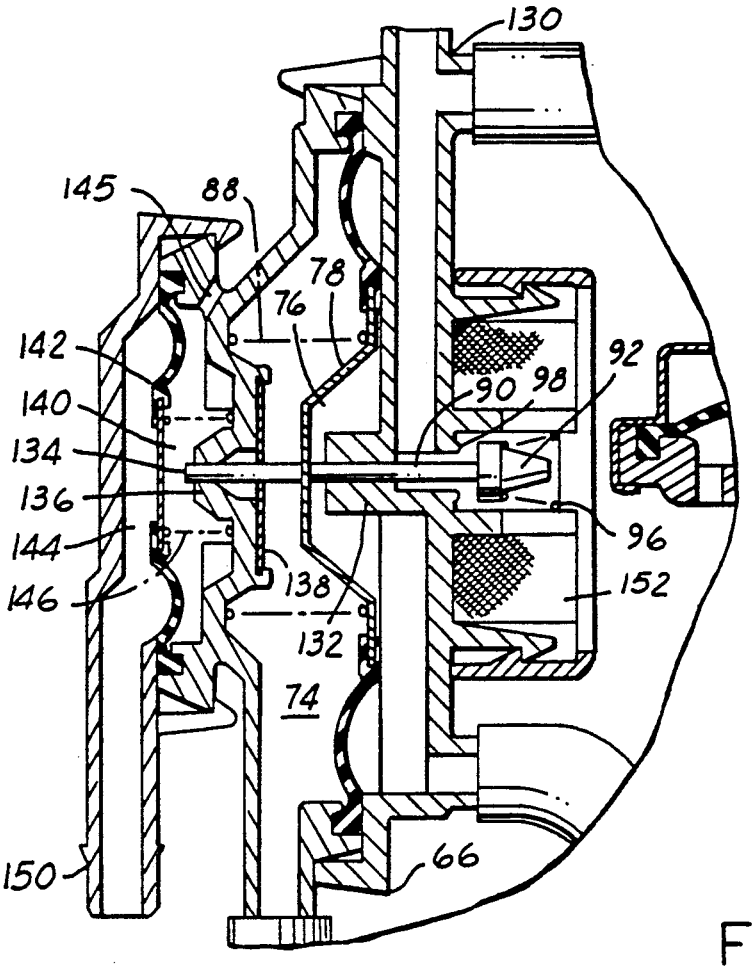
FIG. 3
FIG. 4
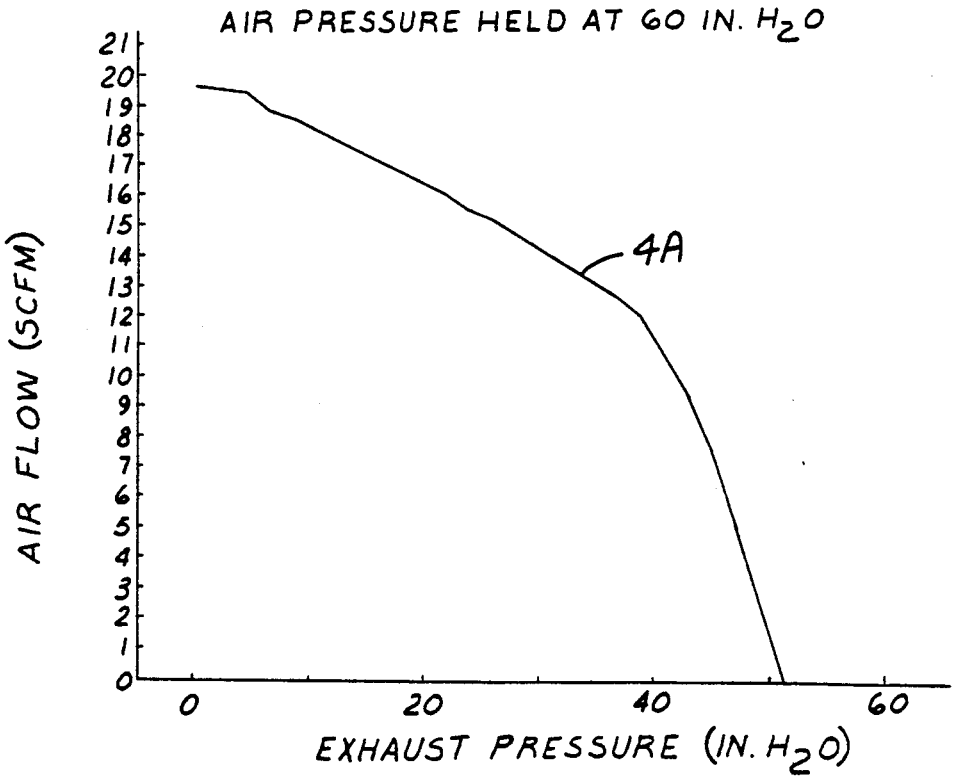

AIR FLOW/CHECK VALVE

REFERENCE TO A RELATED APPLICATION

This application is a continuation-in-part of commonly owned allowed application Ser. No. 07/440,941 filed Nov. 22, 1989, and now abandoned, in the names of the same inventors and bearing the same title.

FIELD OF THE INVENTION

This invention relates to internal combustion engine exhaust emission control systems of the type wherein an air pump delivers air to the exhaust to promote the oxidation of undesirable products of combustion in the hot exhaust gases leaving the engine. More specifically, the invention relates to a new and unique air flow/-check valve that is disposed between the air pump and the exhaust to permit air to be delivered from the pump to the exhaust but to block backflow of potentially damaging exhaust to the air pump.

BACKGROUND AND SUMMARY OF THE INVENTION

During operation of an automotive vehicle's internal combustion engine, some fraction of the fuel introduced into the engine combustion chambers is not fully combusted and remains as an undesirable constituent of the exhaust. In order to promote complete combustion of such residual constituents, secondary air may be pumped into the exhaust before the exhaust is discharged to atmosphere, and typically this is done by means of an air pump. In addition to the air pump, a known type of secondary air system further comprises an electric ported vacuum valve, an air (flow) control valve, and a check valve.

This known system operates by an electric signal input to the ported vacuum valve causing the ported vacuum valve to deliver vacuum to the air valve. The air valve opens to allow air to be pumped from the air pump into the exhaust.

Occasionally back pressure from the exhaust can exceed the air pressure from the pump, and therefore to protect the pump from the backflow of potentially damaging hot exhaust gasses, a one-way (unidirectional) check valve is disposed between the air pump and the exhaust to block any potentially damaging backflow to the air pump.

Some embodiments of this known type of system possess certain potential disadvantages. One potential disadvantage is that three separate assemblies may be required in addition to the air pump; another is that a wiring harness is required to connect to the automotive vehicle's electrical system; still another is that the operating threshold of the check valve can be inconsistent, thereby potentially limiting use to only "high" pressure situations; and yet another is that it does not use operating parameters (air and exhaust pressures) to optimize performance.

The present invention provides improvements that can overcome such disadvantages. The invention can embody all required protection and control functions in a single air flow/check valve assembly. The assembly can be entirely mechanical so that there is no need for electrical wiring harness connection of the assembly into the electrical system. In a general way, the invention may be briefly described as comprising an assembly for sensing the pressure differential across a valve seat and causing the sensed pressure differential to control a vacuum signal for opening and closing a valve member from and against the valve seat to thereby perform air flow/check valve functions. The assembly is also capable of providing protection of the air pump against a series of exhaust pressure surges which collectively, but not individually, may be capable of creating potentially damaging backflow from the exhaust to the air pump.

Further features, advantages, and benefits of the invention will suggest themselves to the reader as the disclosure of the invention proceeds. Drawings accompany the written description, and portray a presently preferred embodiment of the invention according to the best mode contemplated at the present time for carrying out the invention.

BRIEF DESCRIPTION OF THE DRAWINGS

FIG. 3 is a fragmentary enlarged portion of FIG. 2.

FIGS. 4, 5, and 6 are graph plots that is of interest in understanding the operating characteristics of the valve of FIGS. 1, 2, 3, 7, 8, 9 and 10.

DESCRIPTION OF THE PREFERRED EMBODIMENT

Figure 1:
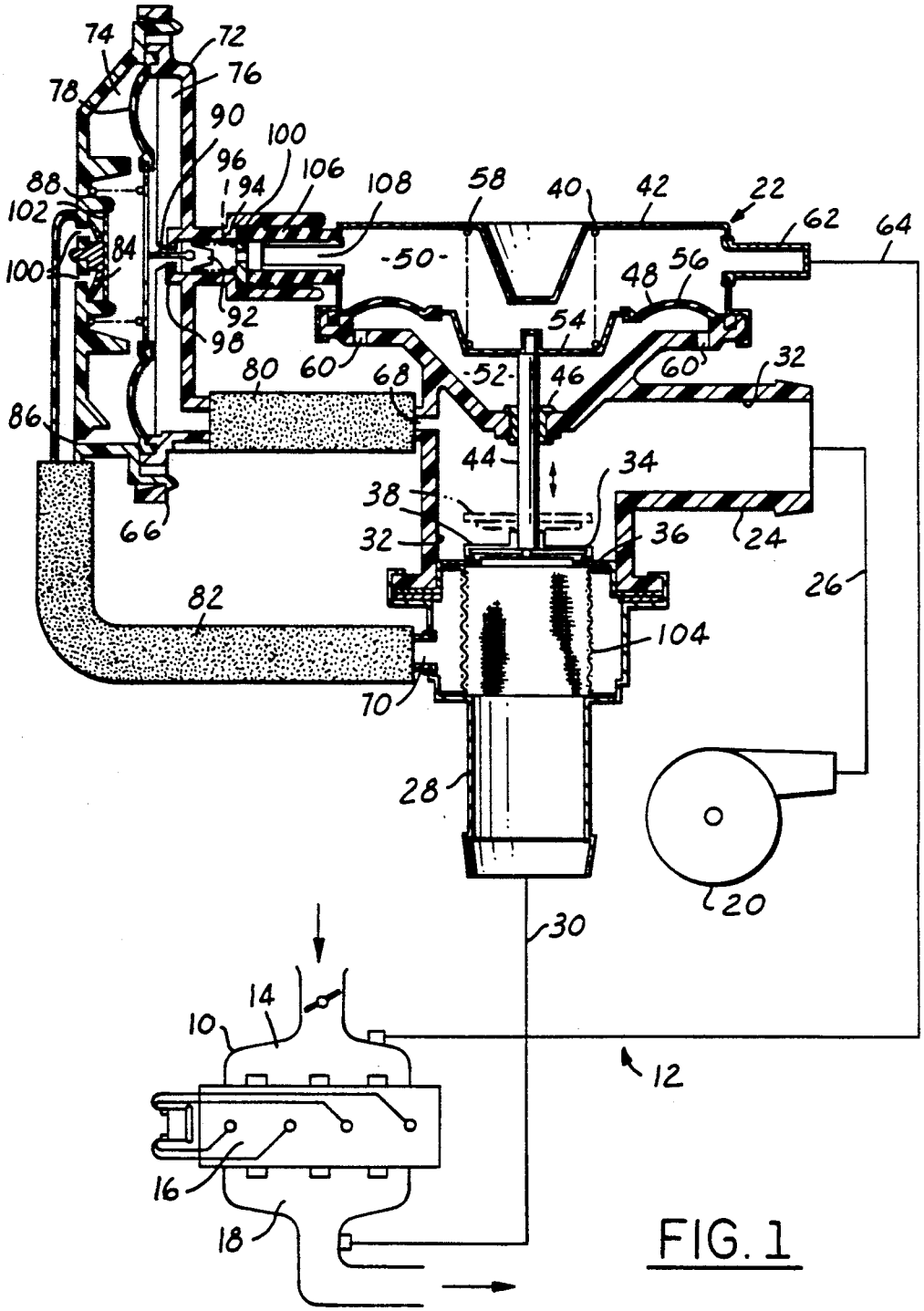
FIG. 1 illustrates details of an air flow/check valve embodying principles of the invention in association with an internal combustion engine exhaust emission control system of the type wherein an air pump delivers air to the exhaust.

In FIG. 1 an internal combustion engine 10 of an automotive vehicle is equipped with an exhaust emission control system 12 embodying the invention. Engine 10 comprises an induction air intake system 14 via which the engine's combustion chambers 16 are charged and an exhaust system 18 via which the hot exhaust gases of combustion are carried away from the combustion chambers.

Exhaust emission control system 12 comprises an electric motor driven air pump 20 and an air flow/-check valve (AFCV) 22. AFCV 22 has an inlet nipple 24 that is communicated to the air pump outlet by a conduit 26 and an outlet nipple 28 that is communicated to exhaust system 18 by a conduit 30. A flow passage 32 extends between inlet 24 and outlet 28, and flow through passage 32 is controlled by a valve mechanism 34. A circular annular valve seat 36 internally circumscribes passage 32 and faces flow from the air pump. A circular disc-shaped valve head 38 is shown, in its solid line position, seated on valve seat 36 closing passage 32 to flow.

An operating mechanism 40 selectively positions valve head 38 with respect to valve seat 36 to open and close passage 32 to flow. In the position shown in broken lines, valve head 38 has been unseated from valve seat 36, in the direction against the flow from the air pump, by operating mechanism 40 thereby allowing flow through passage 32.

Operating mechanism 40 comprises a vacuum actuating mechanism 42, including an actuator shaft 44 that passes through a bushing 46 in the wall of passage 32 to attach to the center of valve head 38. The end of shaft 44 opposite valve head 38 attaches to the center of a two-piece diaphragm 48 whose outer margin is captured so as to divide vacuum actuating mechanism 42 into two variable volume chambers 50 and 52. The two-piece construction of diaphragm 48 consists of a rigid central hub 54 and a surrounding flexible element 56. A helical spring 58 is disposed in chamber 50 and acts to resiliently bias diaphragm 48 so as to cause valve head 34 to seat on seat 36 and disallow flow through passage 32.

Chamber 52 is communicated to atmosphere via vents 60 while chamber 50 has a nipple 62 that provides for a conduit 64 to communicate the suction of engine intake vacuum to chamber 50. Whenever the magnitude of vacuum in chamber 50 is sufficiently high in comparison to the atmospheric pressure in chamber 52, the bias of spring 58 is overcome causing valve head 34 to be unseated from valve seat 36.

A control mechanism 66 serves to control the magnitude of vacuum in chamber 50 and hence exercise control over valve mechanism 34. This control mechanism senses the pressure differential across valve seat 36 by means of two pressure taps 68 and 70. Tap 68 senses the pressure on the side of the valve seat that is toward inlet 32, and tap 70 the pressure of the side that is toward outlet 28. Mechanism 66 comprises a housing 72 that is divided into two variable volume chambers 74 and 76 by a movable wall 78. Pressure tap 68 is communicated to chamber 76 via a conduit 80 while pressure tap 70 is communicated to chamber 74 via a conduit 82. The path of communication between tap 68 and chamber 76 is essentially unrestricted; the path of communication between tap 70 and chamber 74 however, includes a check valve 84 and a bleed 86 whose functions will be explained in more detail hereinafter.

Movable wall 78 is constructed in a similar manner to diaphragm 48 in that it comprises a rigid hub and a flexible rim. A helical spring 88 that is disposed within chamber 74 serves to bias the hub of movable wall 78 against the end of a stem 90 of a valve member 92. The body of valve member 92 is disposed in a passageway 94 that serves to communicate chamber 76 with chamber 50. A helical spring 96 serves to bias the body of valve member 92 to close off one end of a hole 98 through which stem 90 projects from the valve body into chamber 76, and the drawing shows the closed position in which the valve blocks communication between chamber 50 and chamber 76.

In response to certain pressure differential between chambers 74 and 76, movable wall 78 will act on stem 90 to displace valve member 92 away from hole 98. There is sufficient clearance between passageway 94 and the outer periphery of valve member 92 that flow can occur through the passageway when the valve member is displaced away from the hole.

When valve member 92 is closing passageway 94, the magnitude of vacuum that is present in chamber 50 is essentially that of the induction system vacuum. At a sufficiently high vacuum, valve mechanism 34 places air pump 20 in communication with exhaust system 18. When valve member 92 is operated to open passageway 94, vacuum present in chamber 50 is bled from that chamber via chamber 76, conduit 80, and tap 68 to passage 32. Upon a sufficient degree of bleeding of vacuum from chamber 50, operating mechanism 40 seats valve head 38 on valve seat 36 to terminate the communication between air pump 20 and exhaust system 18.

The operation of AFCV 22 can now be explained. When engine 10 is started, vacuum will be delivered to chamber 50. The characteristics of the AFCV are such that this vacuum will open valving mechanism 34. Operation of the air pump will be effective to deliver air through the AFCV to the exhaust system to promote combustion of undesired constituents in the exhaust leaving the engine before the exhaust is discharged from the exhaust system to atmosphere. In this operating mode, the pressure at tap 68 will be higher than that at tap 70 by a certain amount. Because the open valving mechanism 34 is designed to impose a minimum amount of restriction on the flow, this pressure differential will be rather small. It is however sufficiently large to be effective to cause control mechanism 66, acting through operating mechanism 40, to maintain valving mechanism 34 open. This is because the pressure in chamber 76 will be sufficiently large in comparison to that in chamber 74 and the force of spring 88 to prevent movable wall 78 from displacing, via stem 90, valve member 92 to open hole 98. In other words, the vacuum in chamber 50 cannot be bled off.

If the engine should operate in such a manner that the pressure in exhaust system 18 exceeds that produced by air pump 20, i.e. if the exhaust back pressure becomes too large, then the pressure differential sensed by taps 68 and 70 reverses, becoming such that the pressure at tap 70 exceeds that at tap 68. This situation is indicative of potentially damaging backflow through the AFCV to the air pump, and it becomes desirable to promptly close valving mechanism 34 so that potentially damaging backflow to the air pump does not occur. Control mechanism 66 is responsive to this condition in the following way.

The pressure rise at tap 70 is communicated to chamber 74 by the opening of check valve 84. The pressure drop at tap 68 is immediately communicated to chamber 76. As a consequence, the pressure differential across movable wall 78 will expand the volume of chamber 74 and decrease that of chamber 76, causing the movable wall to displace valve member 92 from hole 98 so that passageway 94 now becomes open. The opening of passageway 94 immediately begins bleeding vacuum from chamber 50 with the result that diaphragm 48 is urged to cause valve mechanism 34 to close. As a consequence, backflow from the exhaust to the air pump is now prevented. When the excessive exhaust backpressure terminates, the contents of chamber 74 are allowed to bleed through restricted orifice 86, and when the pressure differential between the respective chambers 74 and 76 has changed sufficiently, valve member 92 again closes hole 94 to allow vacuum to be re-established in chamber 50 for re-opening valve mechanism 34.

The graph plot 4A of FIG. 4 shows a representative relationship between airflow and exhaust pressure for air pressure held at 60 inches $H_2O$. Maximum air flow occurs when the exhaust pressure is lowest and then diminishes as the exhaust pressure increases. Air flow is blocked at a predetermined value of exhaust pressure which is less than the air pressure to provide added safeguard against damaging backflow. This differential pressure is determined by the force of bias spring 88 which is disposed in chamber 74.

A further feature of the AFCV is its ability to respond to a series of exhaust pressure surges which collectively, but not individually, are capable of creating potentially damaging backflow. Such surges are accumulated in chamber 74, and although restricted orifice 86 imposes a bleed on the chamber, a series of surges that have a combination of sufficiently high frequency and amplitudes will be effective to cause valve mechanism 34 to close. In this regard, the operation of the control mechanism is somewhat akin to that of a finite memory integrator.

A few further details should be mentioned. Check valve 84 is an elastomeric umbrella type valve having a retention stem that is fitted into a hole. The umbrella flexes to uncover holes 100 to establish communication between tap 70 and chamber 74. Flow takes place between the periphery of the umbrella and a surrounding ridge. A perforated retainer plate 102 is fitted to the rim of the ridge to confine the umbrella within the ridge.

A cylindrical screen 104 is positioned in alignment with and between nipple 28 and valve seat 36 as an aid to screening particulate exhaust material from entering tap 70.

The connection of chamber 50 to chamber 76 comprises a tubular grommet 106 fitted over a tubular nipple 108 from chamber 50 and a washer 110 against which one end of spring 96 bears.

The invention is especially advantageous with a low pressure air pump because it imposes relatively small restriction to flow from the pump; yet it is sufficiently sensitive to perform the necessary air flow control and check valve functions.

Figure 2:
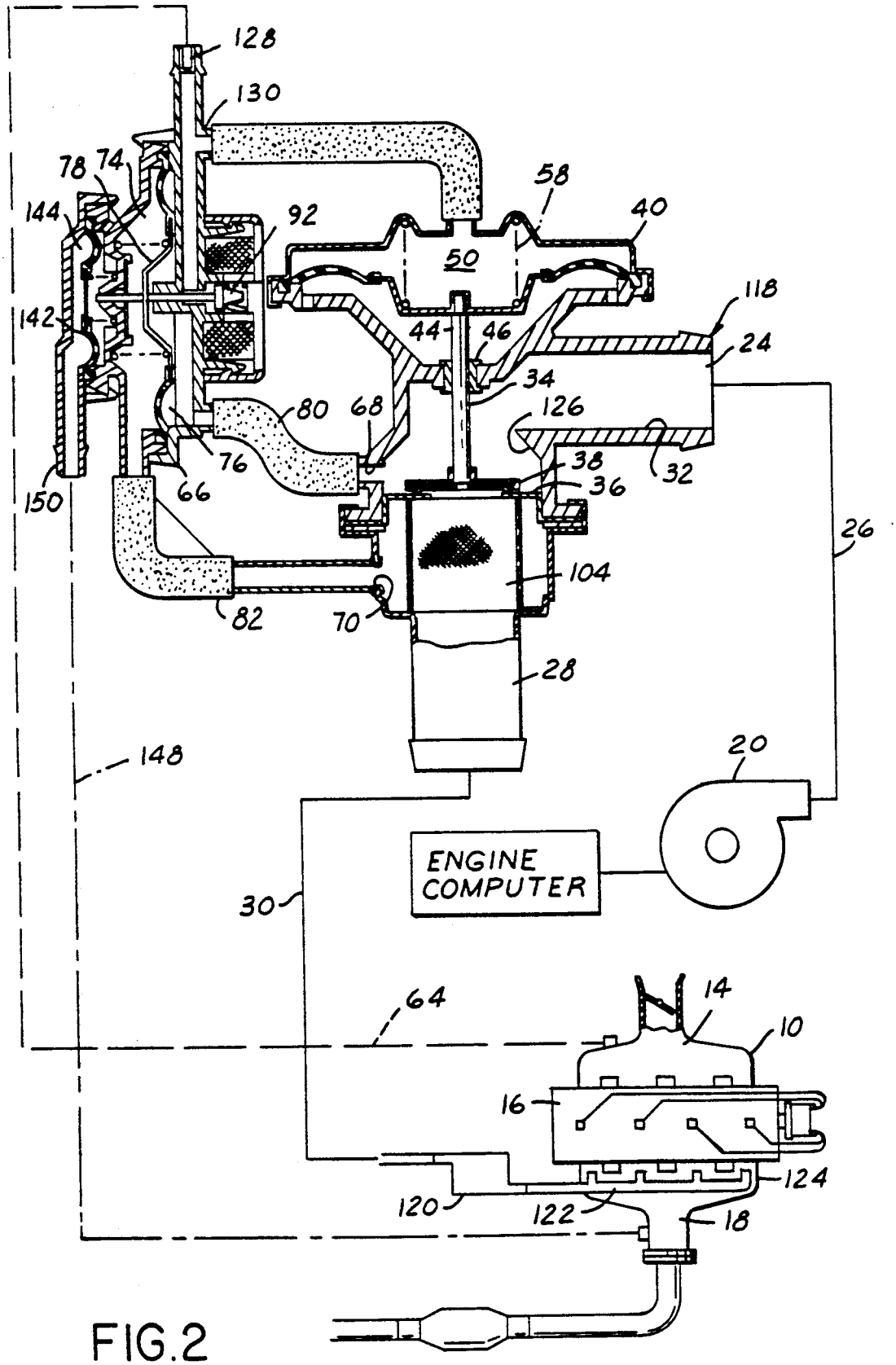
FIG. 2 presents another embodiment of air flow/-check valve embodying principles of the invention.

The embodiment 118 of AFCV depicted in FIGS. 2 and 3 is in certain respects similar to the embodiment of FIG. 1, and so like reference numerals are used to designate similar components of the two embodiments without there necessarily being a detailed description of those components in connection with FIGS. 2 and 3. There are however several significant differences between the two embodiments.

One such difference is that there are two conduits between AFCV 118 and engine exhaust system 18. The valve's outlet nipple 28 connects via conduit 30 to the inlet of a resonator 120 whose outlet connects via a manifold 122 to the exhaust manifold 124 of exhaust system 18 so that an individual stream of air can be injected closely adjacent each engine exhaust valve. Exhaust manifold pressure is sensed by the AFCV at a location that is somewhat further downstream in the exhaust flow where the flow will typically be somewhat smoother.

Another difference between the two embodiments is that the flow passage 32 which extends between inlet 24 and outlet 28 also includes a frustoconically shaped wall portion 126 with which valve head 38 coacts when unseated from seat 36.

Another difference resides in the constructional details of mechanism 66. Chamber 74 is communicated to tap 70 by conduit 82, but unlike the first embodiment, the second omits check valve 84 and bleed 86. As in the first embodiment, chamber 76 is communicated directly to passageway 32 via conduit 80, but now the point of communication with that passageway is located between wall portion 126 and seat 36, and chamber 76 is not vented through valve member 92. While conduit 64 conveys intake manifold vacuum through an orifice 128, as in the first embodiment, the orifice is now located in the body of mechanism 66 rather than in nipple 62; nipple 62 is deleted; and there is a tee 130 which places portions of both mechanisms 40 and 66 in common communication with intake manifold vacuum. The organization of AFCV 118 provides for valve member 92 to controlledly vent chamber 50 to atmosphere in accordance with the position to which movable wall 78 is operated.

The mechanism 66 of AFCV 118 retains a stem 90 to which valve member 92 is affixed and a small spring 96 which acts to urge valve member 92 toward closure of hole 98. Stem 90 is axially guided by a hole in an internal wall portion 132 of the mechanism housing, but is unattached to movable wall 78. Rather, the end of stem 90 which is opposite valve member 92 will merely bear against the center of movable wall 78 when the two are in contact. A pin 134 is disposed coaxial with stem 90, but on the opposite side of movable wall 78. Pin 134 is guided for axial displacement by a hole in another internal wall portion 136 of the mechanism housing and by a hole in an annular scraper member 138 which is supported on wall portion 136 in spaced relation to the first hole. One end of pin 134 is disposed in chamber 74 while its other end is disposed in a further chamber 140 of mechanism 66 which shares wall portion 136 on the opposite side thereof from chamber 74. The remainder of chamber 140 is bounded by a movable wall 142 which forms a portion of a still further chamber 144 lying on the opposite side of movable wall 142 from chamber 140. Chamber 140 is vented to atmosphere via an orifice 145 and contains a helical coil spring 146 that acts to urge movable wall 142 away from pin 134. Chamber 144 is communicated to exhaust pressure via a conduit 148, one end of this conduit being fitted onto a nipple 150 at mechanism 66 while its opposite end is in communication with exhaust manifold 124 downstream of manifold 122. The venting of manifold vacuum to atmosphere by valve element 92 takes place through an annular filter element 152 suitably mounted on mechanism 66.

When the engine is not running, the AFCV can assume a condition like that shown in the drawings. The force of spring 88 overrides that of spring 96 causing valve element 92 to vent chamber 50 to atmosphere. Valve head 38 is therefore forced by spring 58 against seat 36 to close passage 32.

Upon engine starting, intake manifold vacuum is communicated to the AFCV via conduit 64, and exhaust pressure via conduits 30 and 148. Intake manifold vacuum will be bled to atmosphere so long as valve element 92 continues to remain open; consequently, valve head 38 will remain seated on seat 36 until air pump 20 begins to deliver a certain pressure output.

Air pump 20 creates a pressure increase in chamber 76 that generates a force on movable wall 78 opposing the combined forces of spring 88 and of exhaust pressure in chamber 74 acting on the movable wall. The design of spring 88 determines the differential between exhaust pressure and air pump pressure which will be effective to displace movable wall 78 from its illustrated position in the direction toward scraper member 138. By way of example only, a differential of ten inches of water may be required before any displacement of the wall occurs, and thereafter the displacement will increase with increasing differential.

The attainment of a certain differential will be sufficient for spring 96 to close hole 98, and when this happens, intake manifold vacuum ceases to be vented to atmosphere. Now vacuum increases in chamber 50 causing valve head 38 to be unseated from seat 36 and to move into coactivity with frustoconical wall portion 126.

While the resultant opening of passage 32 enables the pumped air to be delivered via the AFCV and resonator 120 into the exhaust system, the coaction that is created between valve head 38 and frustoconical wall portion 126 takes the form of a restriction whose restrictive effect becomes progressively greater the closer the valve head moves toward the frustoconical wall portion. In explaining the functioning of the AFCV, let it be assumed that for a certain given set of operating conditions, valve head 38 occupies a position which imposes a certain degree of restriction on the air pump flow. Mechanism 66 is designed to perform a regulating function whereby valve head 38 is maintained in this position so long as the given set of operating conditions continues unchanged. This regulation occurs in the following manner.

Figure 6:
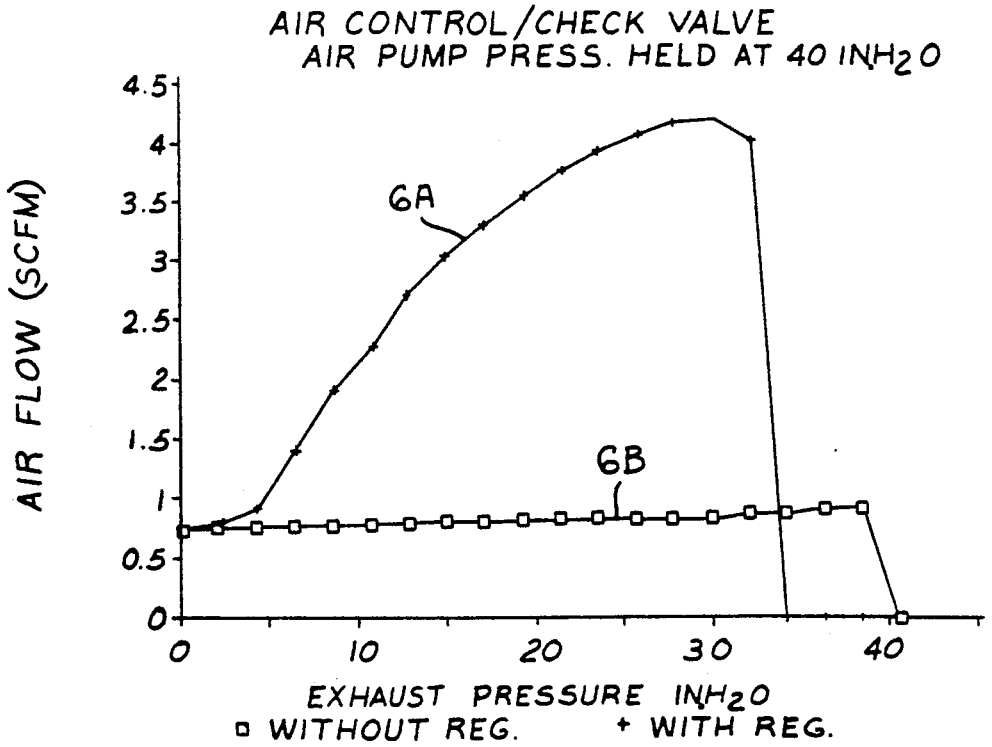

Because valve head 38 moves upstream from tap 68 when it unseats from seat 36, the pressure differential between tap 68 and tap 70 will be less than that which existed before the valve head unseated. Accordingly, movable wall 78 will act on stem 90 to unseat valve element 92 and begin venting chamber 50 to atmosphere. Orifice 128 prevents chamber from being replenished from the manifold faster than it can be bled to atmosphere via hole 98, and therefore as a result of these actions, valve head 38 will begin to move back toward seat 36. This motion lessens the restriction to the air being pumped through the AFCV such that the pressure to chamber 76 is caused to increase with the result that movable wall 78 now begins to move in the opposite direction. These actions that have just been described are continuously repeated at a sufficiently fast rate that the position of valve head 38 is regulated to a stable position. This regulating function is performed over a certain range of exhaust pressure so that proper rate of flow occurs. The graph plot 6A of FIG. 6 shows flow regulation for a typical range of exhaust pressures measured in inches $H_2O$. As the exhaust pressure increases the rate of flow increases. If the exhaust pressure remains at zero the flow rate regulates at a preselected minimum value of approximately 0.75 SCFM as shown on graph plot 6B. By comparison, the graph plot 4A represents a non-regulated valve.

The check valve function of AFCV 118 is performed through the action of movable wall 78 when the sensed exhaust pressure gets too high. The exhaust pressure will act on movable wall 78 in combination with the force of spring 88 such that the movable wall will be axially positioned toward stem 90 to an extent that is a function of the magnitude of the exhaust pressure; specifically, the movable wall is positioned closer to wall portion 132 as the exhaust pressure rises. Beyond a preselected pressure, the movable wall is positioned to a point where it becomes impossible for valve element 92 to regulate due to the fact 78 prevents valve element 92 from closing hole 98. Such a condition continuously vents chamber 50 to atmosphere with the result that valve head 38 is caused to seat on seat 36 and halt the flow through the AFCV. When exhaust pressure has once again dropped below the preselected pressure that initiated the check function, the AFCV can return to the regulating function. Hence, the valve provides flow regulation from the air pump to the exhaust over a certain range of exhaust pressures and flow checking when that pressure range is exceeded.

Figure 5:
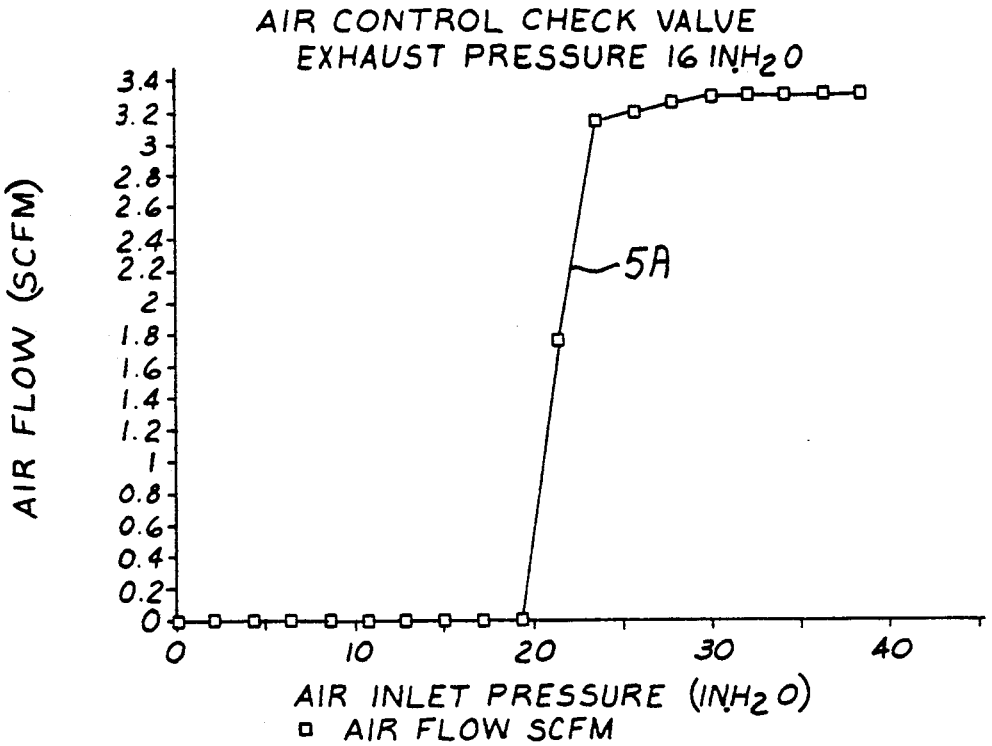

The graph plot 5A of FIG. 5 shows a typical response when a constant exhaust pressure of 16 inches $H_2O$ is maintained at outlet 28. At air pump pressures below 16 inches $H_2O$ the combined force of the exhaust pressure and spring 88 exerted on movable wall 78 will unseat valve member 92 and continuously vent chamber 50 to atmosphere. This condition will cause valve 38 to seat on seat 36 and halt flow.

When the air pump pressure exerts a force on movable wall 78 that exceeds the combined force of 16 inches $H_2O$ exhaust pressure and the force of spring 88, movable wall 78 will move away from wall 132 causing valve element 92 to restrict the bleed of chamber 50 to atmosphere. This will cause valve head 38 to move away from seat 36 allowing air flow to the exhaust.

Figure 7:
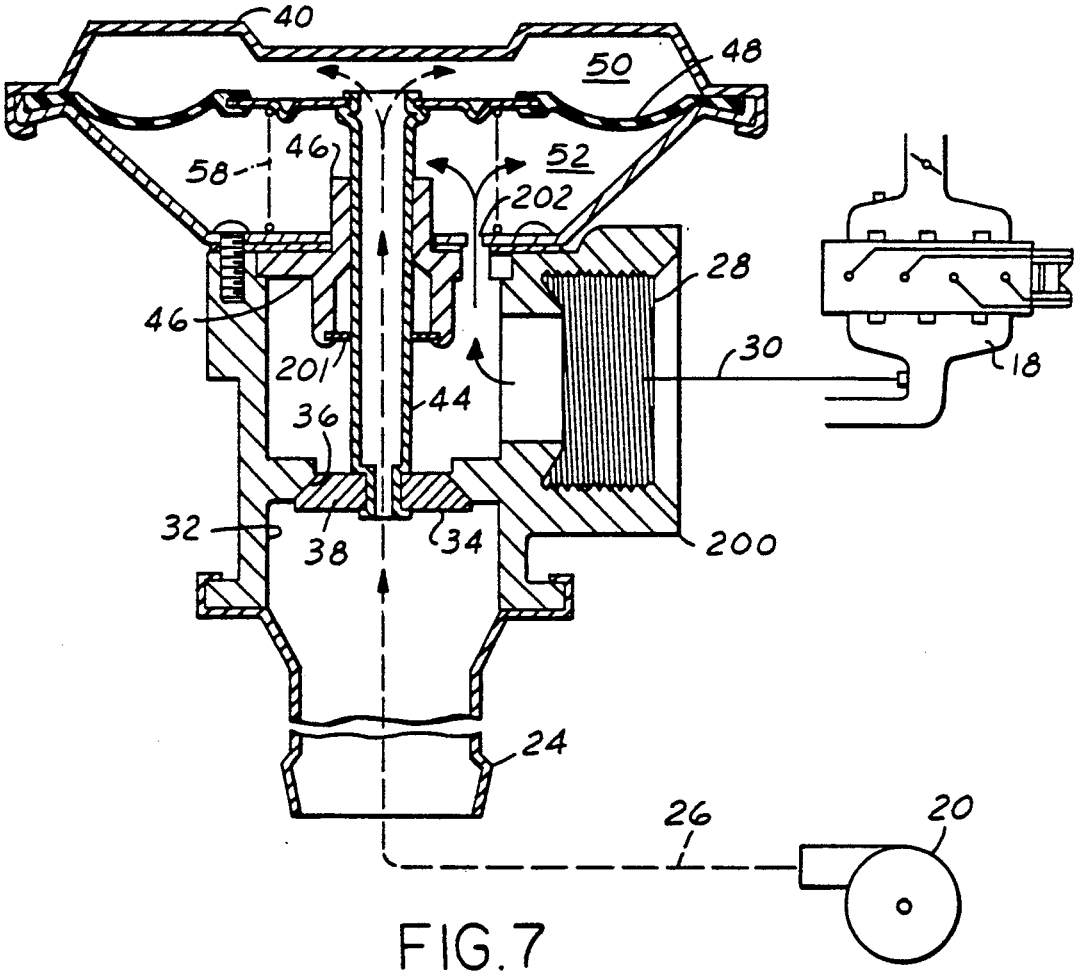
FIG. 7 presents yet another embodiment of air flow/-check valve embodying principles of the invention.

FIG. 7 presents another embodiment 200 of AFCV which possesses a less complex construction than the embodiments that have been described up to this point. Similar components continue to be identified by like reference numerals. The most significant difference between AFCV 200 and the previous embodiments is that AFCV 200 does not utilize intake manifold vacuum; it is only air pump pressure and exhaust pressure (other than of course spring 58) which can exert influence on the operation of valve mechanism 34.

Other significant differences include the following. Inlet 24 is aligned with, and outlet 28 is transverse to, operating mechanism 40. Spring 58 is disposed in chamber 52. Actuator shaft 44 is tubular. Valve seat 36 and valve head 38 are frustoconical. Bushing 46 is provided with accommodations for mounting an annular scraper 201 to act on actuator shaft 44 during movement thereof for the purpose of dislodging any foreign material that might have accumulated on the shaft.

When the engine is off, AFCV 200 assumes the position illustrated in FIG. 7. Spring 58 urges movable wall 48 toward chamber 50 such that valve head 38 seats on seat 36 to close passage 32 to flow. The tubular construction of actuator shaft 44 serves to communicate air pump pressure to chamber 50. A measure of exhaust pressure is communicated to chamber 52 via an orifice 202 which is provided between that chamber and a location in passage 32 which lies between seat 36 and outlet 28. The orifice controls the rate at which flow passes into and out of chamber 52, and hence provides a certain damping of the motion of wall 48.

When the pressure in chamber 50 exceeds that in chamber 52 by an amount sufficient to overcome spring 58, valve head 38 unseats to allow flow from the air pump to the exhaust. In this mode of operation the AFCV performs a regulating function.

Should the exhaust pressure rise too much relative to air pump pressure, the communication provided by orifice 202 will cause chamber 52 to expand and re-seat valve head 38 on seat 36. In this way the AFCV performs a check function to prevent excessive exhaust pressures from acting on the air pump.

The operating characteristic for AFCV 200 is similar to that of the embodiment shown in FIG. 1 and shown in FIG. 4, graph plot 4A.

Figure 8:
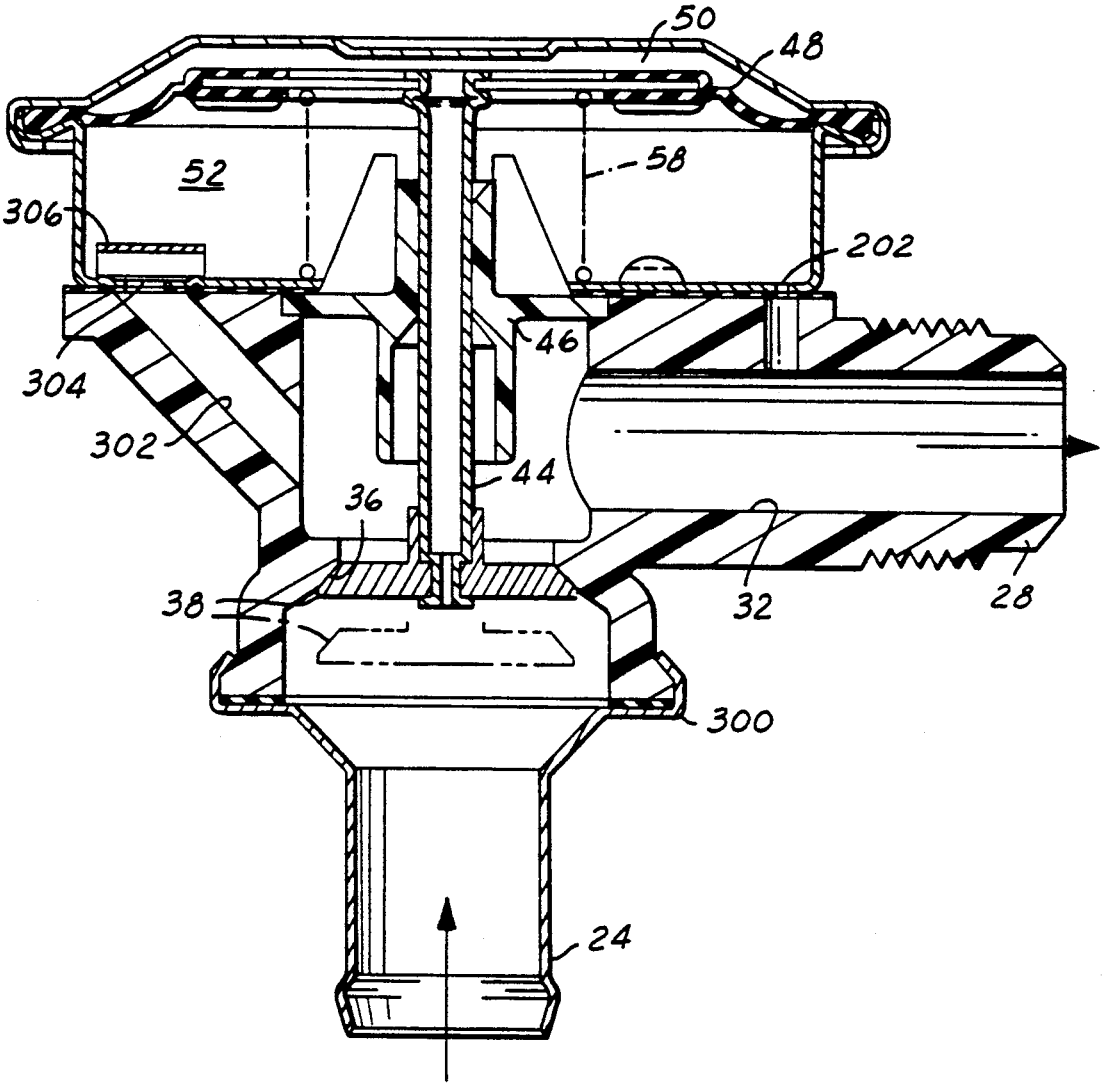
FIGS. 8, 9 and 10 present yet three more respective embodiments of air flow/check valve embodying principles of the invention.

The AFCV 300 of FIG. 8 is essentially like AFCV 200, and so corresponding parts are designated by like reference numbers. The primary difference between the two is that there is a second means of communication of passage 32 to chamber 52 in addition to orifice 202. This second means of communication comprises a slant passage 302 with which a reed valve 304 in chamber 52 coacts. The reed valve functions as a check to allow flow from passage 32 to chamber 52 but to block opposite flow. When closing passage 302, it lies flat against the wall of chamber 52, and when not closing the passage, it flexs in cantilever fashion. Preferably a stop 306 is disposed to overlie the reed.

AFCV 300 will respond to exhaust pressure increases more rapidly than it will to exhaust pressure decreases because this arrangement enables chamber 52 to fill more rapidly than it can exhaust. In other words the AFCV will re-open more slowly than it closes, and this capability may be useful in some air pump systems.

Figure 9:
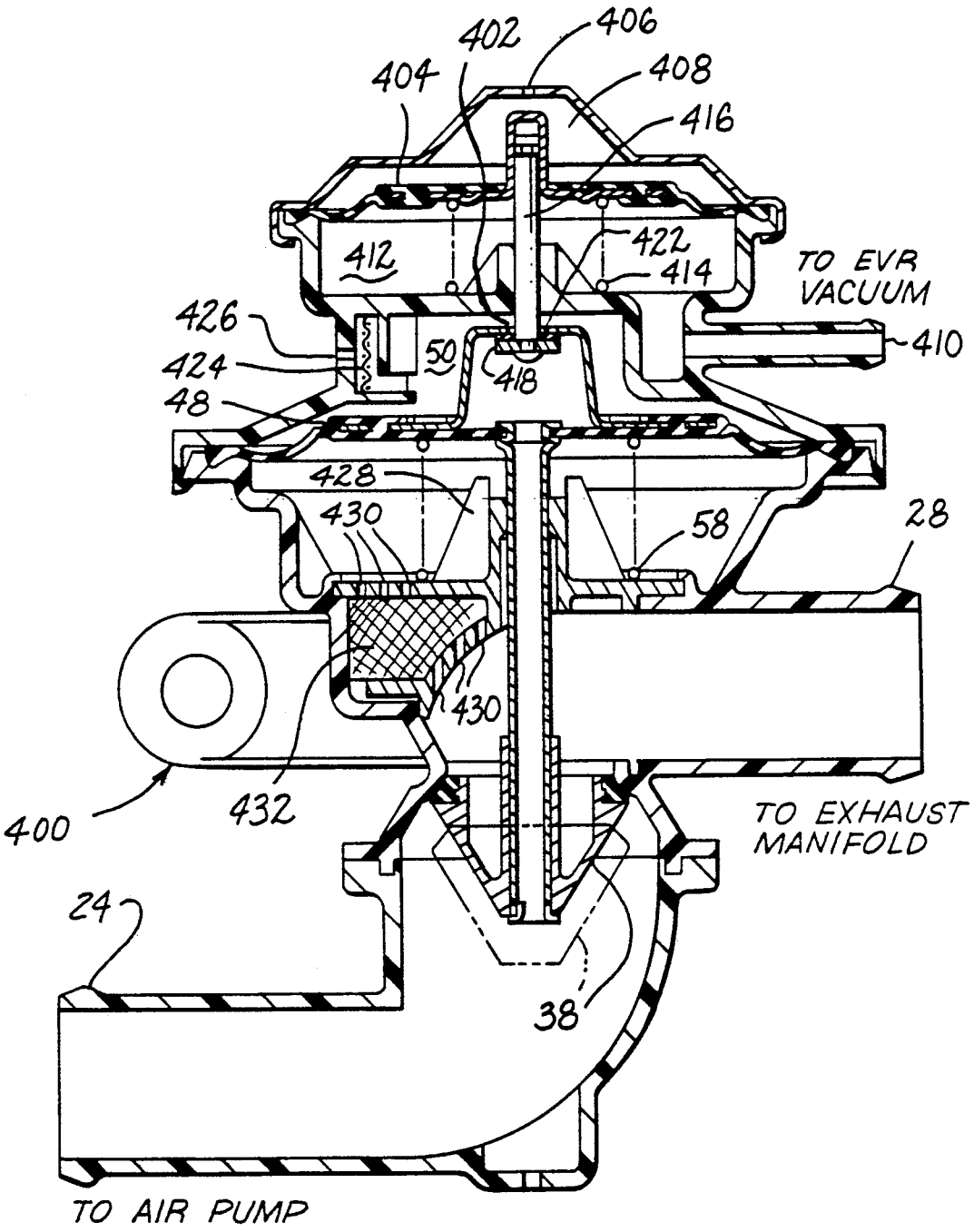

The valve 400 of FIG. 9 has the same air flow and check valve functions as the valve shown in FIG. 7 and has the added feature of rate of flow regulation from an external vacuum source.

Component parts of valve 400 that correspond to like parts of earlier embodiments are identified by the same reference numerals. The following is a brief description of the construction and operation of valve 400.

Air pressure is communicated to the top of diaphragm 48 (i.e. chamber 50) via air inlet 24, the passageway in shaft 44 and a valve 402. Valve 402 is controlled by a diaphragm 404 which is positioned axially as a function of atmospheric air pressure, a spring force, and EVR vacuum. Atmospheric air pressure is communicated through an orifice 406 to a chamber 408 on one side of diaphragm 404. EVR vacuum from an Electronic Vacuum Regulator (not shown) is delivered via a nipple 410 to a chamber 412 on the opposite side of diaphrahm 404. Spring force is applied to the diaphragm by a spring 414 in chamber 412 such that valve 402 is biased closed by the spring force.

When the vacuum (EVR vacuum) is zero, the force of bias spring 414 acts upon diaphragm 404, a shaft 416 and valve 402 to the extent that a valve number 418 on shaft 416 will seat against the plate 420 which is attached to diaphragm 48. This condition will prevent air flow to chamber 50 because valve member 418 is closing a hole 422 in plate 420 through which shaft 416 passes.

When the vacuum is at a level that its force on diaphragm 404 will overcome the force of bias spring 414, it will unseat valve member 418 from plate 420 and allow air flow to the top side of the diaphragm.

When the air pressure is at a level that its force on diaphragm 48 overcomes the force of bias spring 58, it will unseat valve head 38 and allow air flow to the exhaust manifold. Diaphragm 48 will move until its plate 420 again seats on valve number 418 and halts the flow of air to the top of the diaphragm. The air pressure in chamber 50 will bleed off through a filter 424 and orifice 426 in the housing allowing bias spring 58 to move diaphragm 48 and unseat plate 420 from valve member 418. Air flow is again established to the top of the diaphragm and the cycle will repeat causing the diaphragm/plate to regulate its position with the position of valve 402.

The level of EVR vacuum determines the position of valve 402 which then controls the position of valve head 38 and the flow of air to the exhaust. A relationship is now established between the level of vacuum and the rate of air flow to the exhaust.

A check valve function is performed through the action of diaphragm 48 when the sensed exhaust pressure gets too high. The exhaust pressure is communicated to the lower side of diaphragm 48 via openings 430 in guide 428, these openings containing an in-line filter element 432. The exhaust pressure will act upon diaphragm 48 in combination with the force of spring 58 such that it will cause valve head 38 to move toward its seat. Beyond a preselected exhaust pressure the diaphragm is positioned to a point where it causes valve head 38 to be seated and thereby prevent flow between the exhaust 28 and air inlet 24.

Figure 10:
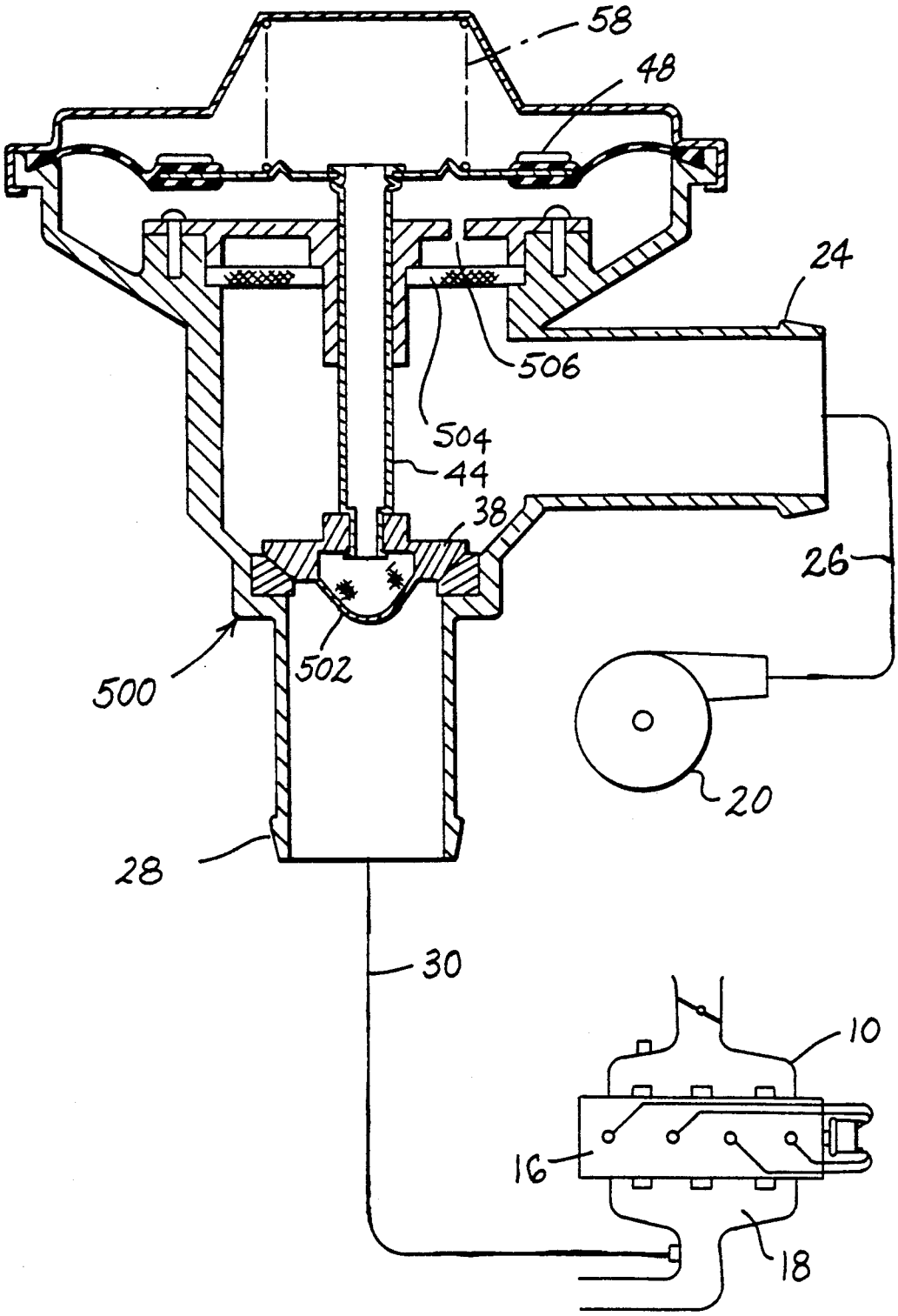

FIG. 10 illustrates an AFCV 500 whose parts that correspond to those of earlier embodiments are designated by like reference numberals. Valve head 38 contains a mesh screen 502 covering the entrance to shaft 44 for filtering any particulates greater than a certain size from the flow. Spring 58 acting on diaphragm 48 normally biases valve head 38 to close the flow path between inlet 24 and exhaust 28. Pump air pressure is communicated to the underside of diaphragm 48 though a filter 504 and orifice 506. The top face of the diaphragm is communicated to exhaust pressure through screen 502 and shaft 44.

As pump pressure builds relative to exhaust pressure, valve head 38 unseats to allow air to flow from the pump to the exhaust manifold. This is because there is a sufficiently greater pressure on the underside of the diaphragm compared to pressure on the top of the diaphragm. The extent of the opening though the AFCV is a function of the relative pressure and the spring has acting on the diaphragm. If the exhaust pressure becomes too great, its transmission through the shaft to the top of the diaphragm will cause valve head 38 to close, thereby checking undesired backflow to the air pump.

While a presently preferred embodiment of the invention has been illustrated and described, it should be understood that principles of the invention may be practiced in other equivalent embodiments.

What is claimed is:

1. In an internal combustion engine exhaust emission control system wherein an air pump delivers air to the exhaust to promote the oxidation of undesirable products of combustion in the hot exhaust gases leaving the engine but is susceptible to potential damage by backflow from the exhaust under certain exhaust conditions tending to create potentially damaging backflow toward the air pump, the improvement comprising air flow/check valve means disposed in flow controlling relationship between the air pump and the exhaust for permitting flow in the direction from the air pump to the exhaust and for blocking backflow in the direction from the exhaust to the air pump, said air flow/check valve means comprising a valving mechanism that is selectively operable to allow and disallow flow between the air pump and the exhaust, and operating means for operating said valving mechanism, said operating means comprising an actuator that is selectively positionable to cause said valving mechanism to selectively allow and disallow flow between the air pump and the exhaust, and a control means for said operating means comprising two pressure sensing taps between the air pump and the exhaust, one of which is upstream of said valving mechanism, and the other of which is downstream of said valving mechanism, and coupling means coupling said two taps with said operating means for causing said actuator to operate said valving mechanism to allow flow between the air pump and the exhaust when the pressure differential sensed by said two taps is indicative of operation of the air pump being effective to cause the pumping of air into the exhaust and for causing said actuator to operate said valving mechanism to disallow flow between the air pump and the exhaust when the pressure differential sensed by said two taps indicates a condition of the exhaust tending to create potentially damaging backflow of exhaust to the air pump.

2. The improvement set forth in claim 1 wherein said coupling means comprises a control mechanism for keeping a running accumulation of certain time-weighted pressure differentials between said two taps and is effective to cause said actuator to operate said valving mechanism to disallow flow between the air pump and the exhaust when the running accumulation of certain time-weighted pressure differentials between said two taps exceeds a predetermined valuation.

3. The improvement set forth in claim 2 wherein said control mechanism comprises a variable volume chamber that is connected to said other tap by a check valve that allows flow from said other tap into said chamber to increase the volume thereof, but not from said chamber to said other tap, and a bleed via which the contents of said chamber are gradually bled back to said other tap to decrease the volume of said chamber.

4. The improvement set forth in claim 3 wherein said variable volume chamber comprises a movable wall that is positioned according to the volume of said chamber, said operating means comprises a vacuum actuating mechanism for selectively positioning said actuator, and said coupling means comprises a control valve that is operated by said movable wall to control the magnitude of vacuum that is applied to said vacuum actuating mechanism for selectively positioning said actuator.

5. The improvement set forth in claim 4 wherein vacuum derived from the engine's intake suction is delivered to said vacuum actuating mechanism, and said control valve is arranged to control the bleed of vacuum from said vacuum actuating mechanism.

6. The improvement set forth in claim 5 wherein said control valve is disposed in flow controlling relationship between said vacuum actuating mechanism and said one tap.

7. The improvement set forth in claim 1 wherein said coupling means comprises a variable volume chamber whose volume is a function of pressure differential sensed by said two taps, said variable volume chamber comprises a movable wall that is positioned according to the volume of said chamber, said operating means comprises a vacuum actuating mechanism for selectively positioning said actuator, and said coupling means comprises a control valve that is operated by said movable wall to control the magnitude of vacuum that is applied to said vacuum actuating mechanism for selectively positioning said actuator.

8. The improvement set forth in claim 1 wherein said coupling means comprises a housing divided into two variable volume chambers by a movable wall, a conduit from said one tap to one of said chambers, another conduit from said other tap to the other of said chambers, and said operating means comprises an actuating mechanism that is under the control of said movable wall to selectively position said actuator.

9. The improvement set forth in claim 8 including a check valve through which flow from said other tap must pass before entering said other chamber, and a bleed for gradually bleeding the contents of said other chamber.

10. The improvement set forth in claim 1 including a bias spring acting to bias said valving mechanism toward disallowing flow between the air pump and the exhaust.

11. The improvement set forth in claim 10 wherein said valving mechanism comprises a valve seat circumscribing a flow path through said air flow/check valve means from the air pump to the exhaust and a valving member that is operated by said actuator to control flow through said flow path by seating on and unseating from said valve seat, said valve seat faces flow from the air pump, and said valving member moves against flow from the air pump as it unseats from said valve seat.

12. The improvement set forth in claim 11 wherein said operating means comprises two variable volume chambers bounding opposites sides of a movable diaphragm that positions said actuator and said coupling means comprises means to cause the pressures sensed at said taps to control the volumes of said two chambers and hence control the position of said diaphragm.

13. The improvement set forth in claim 12 wherein said one tap communicates directly with one of said two chambers and said other tap communicates directly to the other of said two chambers.

14. The improvement set forth in claim 13 wherein said one tap communicates with said one chamber through an orifice which imposes a restriction on flow between said one tap and said one chamber that is greater than whatever restriction is present in the communication between said other tap and said other chamber.

15. The improvement set forth in claim 14 wherein said actuator is a hollow shaft that provides the communication of said other tap to said other chamber.

16. The improvement set forth in claim 15 including a filter medium disposed in covering relation to said hollow shaft to filter certain particulates from the flow that enters said hollow shaft at said other tap.

17. The improvement set forth in claim 12 wherein said actuator comprises a hollow shaft that directly communicates one of said two chambers with said one tap.

18. The improvement set forth in claim 17 including regulator valve means for regulating the pressure in said other chamber in accordance with an externally supplied signal to in turn regulate the position of said diaphragm.

19. The improvement set forth in claim 18 wherein said signal is a vacuum signal and said air flow/check valve means includes a vacuum motor that operates said regulator valve means in accordance with said vacuum signal.

20. The improvement set forth in claim 19 wherein said regulator valve means comprises a valve seat carried by said diaphragm and a valve element that is positioned by said vacuum motor for coaction with said valve seat in regulating the position of said diaphragm.

21. The improvement set forth in claim 1 wherein said operating means comprises two variable volume chambers bounding opposites sides of a movable diaphragm that positions said actuator and said coupling means comprises means to cause the pressures sensed at said taps to control the volumes of said two chambers and hence control the position of said diaphragm.

22. The improvement set forth in claim 21 wherein a first of said taps communicates directly with one of said two chambers and a second of said taps communicates directly to the other of said two chambers.

23. The improvement set forth in claim 22 wherein said first tap communicates with said one chamber through an orifice which imposes a restriction on flow between said first tap and said one chamber that is greater than whatever restriction is present in the communication between said second tap and said other chamber.

24. The improvement set forth in claim 23 wherein said actuator is a hollow shaft that provides the communication of said second tap to said other chamber.

25. The improvement set forth in claim 24 including a filter medium disposed in covering relation to said hollow shaft to filter certain particulates from the flow that enters said hollow shaft at said second tap.

26. The improvement set forth in claim 22 wherein said actuator comprises a hollow shaft that directly communicates said one chamber with said first tap.

27. The improvement set forth in claim 26 including regulator valve means for regulating the pressure in said other chamber in accordance with an externally supplied signal to in turn regulate the position of said diaphragm.

28. The improvement set forth in claim 27 wherein said signal is a vacuum signal and said air flow/check valve means includes a vacuum motor that operates said regulator valve means in accordance with said vacuum signal.

29. The improvement set forth in claim 28 wherein said regulator valve means comprises a valve seat carried by said diaphragm and a valve element that is positioned by said vacuum motor for coaction with said valve seat in regulating the position of said diaphragm.

30. The improvement set forth in claim 1 wherein said coupling means comprises a housing having a first portion divided into two variable volume chambers by a movable wall, a conduit from said one tap to one of said chambers, another conduit from said other tap to the other of said chambers, said housing having a second portion divided into its own two variable volume chambers by its own movable wall, means venting one of said chambers of said further housing portion to atmosphere, means communicating the other of said chambers of said further housing portion to sense engine exhaust pressure, and said operating means comprises an actuating mechanism that is under the control of said movable walls to selectively position said actuator such that said movable wall of said second housing portion is effective via said first housing portion's movable wall to cause said valving means to check the flow between the air pump and exhaust when the sensed exhaust pressure becomes too high relative to atmospheric pressure, and said movable wall of said first housing portion is effective to allow controlled flow from the air pump to the exhaust when the pressure differential sensed by said two taps is indicative of operation of the air pump being effective to cause the pumping of air into the exhaust.

31. In an internal combustion engine exhaust emission control system wherein an air pump delivers air to the exhaust to promote the oxidation of undesirable products of combustion in the hot exhaust gases leaving the engine but is susceptible to potential damage by backflow from the exhaust under certain exhaust conditions tending to create potentially damaging backflow toward the air pump, the improvement comprising air flow/check valve means disposed in flow controlling relationship between the air pump and the exhaust for permitting flow in the direction from the air pump to the exhaust and for blocking backflow in the direction from the exhaust to the air pump, said air flow/check valve means comprising a valving mechanism that is selectively operable in a passage to allow and disallow flow between the air pump and the exhaust, said valving mechanism comprising a valve seat internally circumscribing said passage and a valve member that is selectively positionable to seat on and unseat from said valve seat to respectively close and open said passage to flow, sensing means for sensing pressure differential across said valve seat, an actuating mechanism for selectively positioning said valve member, and coupling means coupling said sensing means with said actuating mechanism for causing the sensed pressure differential across said valve seat to influence the positioning of said valve member by said actuating mechanism, including causing said actuating mechanism to position said valve member seated on said valve seat when the pressure across said valve seat tends to create potentially damaging backflow from the exhaust toward the air pump.

32. The improvement set forth in claim 31 wherein said sensing means comprises two pressure sensing taps that are disposed in pressure sensing relationship to said passage on opposite sides of said valve seat.

33. The improvement set forth in claim 32 wherein said coupling means comprises a control mechanism for keeping a running accumulation of certain time-weighted pressure differentials between said two taps and is effective to cause said actuating mechanism to position said valve member seated on said seat when the running accumulation of certain time-weighted pressure differentials between said two taps exceeds a predetermined valuation.

34. The improvement set forth in claim 33 wherein said control mechanism comprises a variable volume chamber that is connected to one of said taps by a check valve that allows only unidirectional flow between said one tap and said chamber to vary the volume thereof, and a bleed via which the volume of said chamber is allowed to gradually vary in the opposite sense from which its volume was varied by flow through said check valve.

35. The improvement set forth in claim 34 wherein said variable volume chamber comprises a movable wall that is positioned according to the volume of said chamber, said actuating mechanism is operated by an operating means that comprises a vacuum actuator, and said coupling means comprises a control valve that is operated by said movable wall to control the magnitude of vacuum that is applied to said vacuum actuator for selectively positioning said valve member.

36. The improvement set forth in claim 35 wherein vacuum derived from the engine intake suction is delivered to said vacuum actuator, and said control valve is arranged to control the bleed of vacuum from said vacuum actuator.

37. The improvement set forth in claim 31 wherein said operating means comprises two variable volume chambers bounding opposites sides of a movable diaphragm that positions said actuator and said coupling means comprises means to cause the pressures sensed at said taps to control the volumes of said two chambers and hence control the position of said diaphragm.

38. The improvement set forth in claim 37 wherein a first of said taps communicates directly with one of said two chambers and a second of said taps communicates directly to the other of said two chambers.

39. The improvement set forth in claim 38 wherein said first tap communicates with said one chamber through an orifice which imposes a restriction on flow between said first tap and said one chamber that is greater than whatever restriction is present in the communication between said second tap and said other chamber.

40. The improvement set forth in claim 39 wherein said actuator is a hollow shaft that provides the communication of said second tap to said other chamber.

41. The improvement set forth in claim 40 including a filter medium disposed in covering relation to said hollow shaft to filter certain particulates from the flow that enters said hollow shaft at said second tap.

42. The improvement set forth in claim 38 wherein said actuator comprises a hollow shaft that directly communicates said one chamber with said first tap.

43. The improvement set forth in claim 42 including regulator valve means for regulating the pressure in said other chamber in accordance with an externally supplied signal to in turn regulate the position of said diaphragm.

44. The improvement set forth in claim 43 wherein said signal is a vacuum signal and said air flow/check valve means includes a vacuum motor that operates said regulator valve means in accordance with said vacuum signal.

45. The improvement set forth in claim 44 wherein said regulator valve means comprises a valve seat carried by said diaphragm and a valve element that is positioned by said vacuum motor for coaction with said valve seat in regulating the position of said diaphragm.

46. An air flow/check valve for use in an internal combustion engine exhaust emission control system wherein an air pump delivers air to the exhaust to promote the oxidation of undesirable products of combustion in the hot exhaust gases leaving the engine and the air flow/check valve is adapted to be operatively disposed between the air pump and the exhaust for allowing flow from the air pump to the exhaust and disallowing potentially damaging backflow from the exhaust to the air pump, said air flow/check valve comprising an inlet adapted to be placed in communication with the air pump, an outlet adapted to be placed in communication with the exhaust, a passage between said inlet and said outlet, a valve seat internally circumscribing said passage, a valve member that is selectively positionable to seat on and unseat from said valve seat to respectively close and open said passage to flow, operating means comprising an actuating mechanism for selectively positioning said valve member, a control means for said operating means, said control means comprising two pressure sensing taps, one communicating with said passage between said inlet and said valve seat, and the other communicating with said passage between said valve seat and said outlet, and coupling means coupling said two taps with said operating means for influencing the positioning of said valve member by said actuating mechanism, including causing said actuating mechanism to position said valve member seated on said valve seat when the pressure across said valve seat tends to create potentially damaging backflow from the exhaust toward the air pump.

47. A valve as set forth in claim 46 wherein said coupling means comprises a control mechanism for keeping a running accumulation of certain time-weighted pressure differentials between said two taps and is effective to cause said actuating mechanism to operate said valve member to seat on said valve seat when the running accumulation of certain time-weighted pressure differentials between said two taps exceeds a predetermined valuation.

48. The improvement set forth in claim 47 wherein said control mechanism comprises a variable volume chamber that is connected to said other tap by a check valve that allows flow from said other tap into said chamber to increase the volume thereof, but not from said chamber to said other tap, and a bleed via which the contents of said chamber are gradually bled back to said other tap to decrease the volume of said chamber.

49. The improvement set forth in claim 48 wherein said variable volume chamber comprises a movable wall that is positioned according to the volume of said chamber, said actuating mechanism comprises a vacuum actuator for selectively positioning said valve member, and said coupling means comprises a control valve that is operated by said movable wall to control the magnitude of vacuum that is applied to said vacuum actuator for selectively positioning said valve member.

50. The improvement set forth in claim 49 wherein said control valve is arranged to control the bleed of vacuum from said vacuum actuator.

51. The improvement set forth in claim 50 wherein said control valve is disposed in flow controlling relationship between said vacuum actuator and said one tap.

52. The improvement set forth in claim 46 wherein said coupling means comprises a variable volume chamber whose volume is a function of pressure differential sensed by said two taps, said variable volume chamber comprises a movable wall that is positioned according to the volume of said chamber, said actuating mechanism comprises a vacuum actuator for selectively positioning said valve member, and said coupling means comprises a control valve that is operated by said movable wall to control the magnitude of vacuum that is applied to said vacuum actuator for selectively positioning said valve member.

53. The improvement set forth in claim 46 wherein said coupling means comprises a housing divided into two variable volume chambers by a movable wall, a conduit from said one tap to one of said chambers, another conduit from said other tap to the other of said chambers, and said actuating mechanism is under the control of said movable wall to selectively position said valve member.

54. The improvement set forth in claim 53 including a check valve through which flow from said other tap must pass before entering said other chamber, and a bleed for gradually bleeding the contents of said other chamber.

55. The improvement set forth in claim 46 wherein said operating means comprises two variable volume chambers bounding opposites sides of a movable diaphragm that positions said actuator and said coupling means comprises means to cause the pressures sensed at said taps to control the volumes of said two chambers and hence control the position of said diaphragm.

56. The improvement set forth in claim 55 wherein a first of said taps communicates directly with one of said two chambers and a second of said taps communicates directly to the other of said two chambers.

57. The improvement set forth in claim 56 wherein said first tap communicates with said one chamber through an orifice which imposes a restriction on flow between said first tap and said one chamber that is greater than whatever restriction is present in the communication between said second tap and said other chamber.

58. The improvement set forth in claim 57 wherein said actuator is a hollow shaft that provides the communication of said second tap to said other chamber.

59. The improvement set forth in claim 58 including a filter medium disposed in covering relation to said hollow shaft to filter certain particulates from the flow that enters said hollow shaft at said second tap.

60. The improvement set forth in claim 56 wherein said actuator comprises a hollow shaft that directly communicates said one chamber with said first tap.

61. The improvement set forth in claim 60 including regulator valve means for regulating the pressure in said other chamber in accordance with an externally supplied signal to in turn regulate the position of said diaphragm.

62. The improvement set forth in claim 61 wherein said signal is a vacuum signal and said air flow/check valve means includes a vacuum motor that operates said regulator valve means in accordance with said vacuum signal.

63. The improvement set forth in claim 62 wherein said regulator valve means comprises a valve seat carried by said diaphragm and a valve element that is positioned by said vacuum motor for coaction with said valve seat in regulating the position of said diaphragm.

64. In an internal combustion engine exhaust emission control system wherein an air pump delivers air to the exhaust to promote the oxidation of undesirable products of combustion in the hot exhaust gases leaving the engine but is susceptible to potential damage by backflow from the exhaust under certain exhaust conditions tending to create potentially damaging backflow toward the air pump, the improvement comprising a valve mechanism disposed in flow controlling relationship between the air pump and the exhaust for permitting flow in the direction from the air pump to the exhaust and for blocking backflow in the direction from the exhaust to the air pump, and control means for said valve mechanism comprising sensing means for sensing pressure differential between two points, one of which is disposed between the air pump and said valve mechanism, and the other of which is disposed between the valve mechanism and the exhaust, and control and operating means for controlling and operating said valve mechanism by said sensing means.

65. In an internal combustion engine exhaust emission control system wherein an air pump delivers air to the exhaust to promote the oxidation of undesirable products of combustion in the hot exhaust gases leaving the engine but is susceptible to potential damage by backflow from the exhaust under certain exhaust conditions tending to create potentially damaging backflow toward the air pump, the improvement comprising air flow/check valve means disposed in flow controlling relationship between the air pump and the exhaust for permitting flow in the direction from the air pump to the exhaust and for blocking backflow in the direction from the exhaust to the air pump, said air flow/check valve means comprising a valving mechanism that is selectively operable in a passage to allow and disallow flow between the air pump and the exhaust, said valving mechanism comprising a valve seat internally circumscribing said passage and a valve member that is selectively positionable to seat on and unseat from said valve seat to respectively close and open said passage to flow, a wall portion internally circumscribing said passage in spaced relation to said seat, sensing means for sensing pressure at different points along said passage, an actuating mechanism for selectively positioning said valving mechanism, and coupling means coupling said sensing means with said actuating mechanism for causing sensed pressures within said passage to influence the positioning of said valving mechanism by said actuating mechanism, including causing said actuating mechanism to position said valving mechanism to seat said valve member on said valve seat when sensed pressures indicate the presence of potentially damaging backflow from the exhaust toward the air pump and causing said actuating mechanism to position said valving mechanism to coact said valve member with said wall portion and set a restriction for said passage when sensed pressures indicate that operation of the air pump is effective to deliver air to the exhaust.

66. The improvement set forth in claim 65 wherein said sensing means comprises two pressure sensing taps that are disposed in pressure sensing relationship to said passage on opposite sides of said valve seat, one of said pressure sensing taps also being disposed between said wall portion and said seat.

67. An air flow/check valve for use in an internal combustion engine exhaust emission control system wherein an air pump delivers air to the exhaust to promote the oxidation of undesirable products of combustion in the hot exhaust gases leaving the engine and the air flow/check valve is adapted to be operatively disposed between the air pump and the exhaust for allowing flow from the air pump to the exhaust and disallowing potentially damaging backflow from the exhaust to the air pump, said air flow/check valve comprising an inlet adapted to be placed in communication with the air pump, an outlet adapted to be placed in communication with the exhaust, a passage between said inlet and said outlet, a valve seat internally circumscribing said passage, a valve member that is selectively positionable to seat on and unseat from said valve seat to respectively close and open said passage to flow, operating means for operating said valve member, said operating means comprising an actuator that is selectively positionable to cause said valve member to selectively allow and disallow flow between the inlet and outlet, and a control means for said operating means comprising two pressure sensing taps between the inlet and outlet, one of which is upstream of said valve member, and the other of which is downstream of said valve member when said valve member is functioning as a check but upstream of said valve member when said valve member is functioning to allow controlled flow from the inlet to the outlet, and coupling means coupling said two taps with said operating means for causing said actuator to operate said valve member to allow controlled flow from the inlet to the outlet when the pressure differential sensed by said two taps is indicative of operation of the air pump being effective to cause the pumping of air into the exhaust and for causing said actuator to operate said valve member to check flow between the inlet and the outlet when the pressure differential sensed by said two taps indicates a condition of the exhaust tending to create potentially damaging backflow of exhaust to the air pump.

68. The improvement set forth in claim 67 wherein said coupling means comprises a housing having a first portion divided into two variable volume chambers by a movable wall, a conduit from said one tap to one of said chambers, another conduit from said other tap to the other of said chambers, said housing having a second portion divided into its own two variable volume chambers by its own movable wall, means venting one of said chambers of said further housing portion to atmosphere, means adapted to communicate the other of said chambers of said further housing portion to sense engine exhaust pressure, and said operating means comprises a means that is under the control of said movable walls to selectively position said actuator such that said movable wall of said second housing portion is effective via said first housing portion's movable wall to cause said valve member to check the flow between the inlet and outlet when the sensed exhaust pressure becomes too high relative to atmospheric pressure, and said movable wall of said first housing portion is effective to allow controlled flow from the inlet to the outlet when the pressure differential sensed by said two taps is indicative of operation of the air pump being effective to cause the pumping of air into the exhaust.

69. An air flow/check valve for use in an internal combustion engine exhaust emission control system wherein an air pump delivers air to the exhaust to promote the oxidation of undesirable products of combustion in the hot exhaust gases leaving the engine and the air flow/check valve is adapted to be operatively disposed between the air pump and the exhaust for allowing flow from the air pump to the exhaust and disallowing potentially damaging backflow from the exhaust to the air pump, said air flow/check valve comprising an inlet adapted to be placed in communication with the air pump, an outlet adapted to be placed in communication with the exhaust, a passage between said inlet and said outlet, a valve seat internally circumscribing said passage, a valve member that is selectively positionable to seat on and unseat from said valve seat to respectively close and open said passage to flow, a wall portion internally circumscribing said passage in spaced relation to said seat, sensing means for sensing pressure at different points along said passage, an actuating mechanism for selectively positioning said valve member, and coupling means coupling said sensing means with said actuating mechanism for causing sensed pressures within said passage to influence the positioning of said valve member by said actuating mechanism, including causing said actuating mechanism to position said valve member seated on said valve seat when sensed pressures indicate the presence of potentially damaging backflow from the exhaust toward the air pump and causing said actuating mechanism to position said valve member to coact with said wall portion and set a restriction for said passage when sensed pressures indicate that operation of the air pump is effective to deliver air to the exhaust.

* * * * *